US007693460B2

(12) United States Patent
Furukawa

(10) Patent No.: US 7,693,460 B2
(45) Date of Patent: Apr. 6, 2010

(54) IMAGE FORMING APPARATUS

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 357 days.

(21) Appl. No.: 11/874,989

(22) Filed: Oct. 19, 2007

(65) Prior Publication Data

US 2008/0317506 A1 Dec. 25, 2008

(30) Foreign Application Priority Data

Jun. 25, 2007 (JP) ..... 2007-166675

(51) Int. Cl.
*G03G 15/01* (2006.01)

(52) U.S. Cl. ..... 399/223; 399/299; 399/303

(58) Field of Classification Search ..... 399/71, 399/222, 223, 297–303, 308
See application file for complete search history.

(56) References Cited

U.S. PATENT DOCUMENTS 6,636,711 B1 * 10/2003 Katahira ..... 399/82
6,941,101 B2 * 9/2005 Kato ..... 399/297
7,368,212 B2 * 5/2008 Sugiura et al. ..... 430/109.4
7,415,224 B2 * 8/2008 Hayakawa, Atsushi ..... 399/111

FOREIGN PATENT DOCUMENTS

JP 2001-005360 1/2001

* cited by examiner

*Primary Examiner*—Hoan H Tran
(74) *Attorney, Agent, or Firm*—Banner & Witcoff, Ltd.

(57) ABSTRACT

An image forming apparatus is provided which includes a switching mechanism which selectively shifts developing rollers among an all-color non-contact state in which all photosensitive members are kept apart from the corresponding developing rollers, a black contact state in which only the photosensitive member for black is kept in contact with the corresponding developing roller, and an all-color contact state in which all the photosensitive members are kept in contact with the corresponding developing rollers, and a control section which, when an operation mode of the apparatus is shifted from a color mode to a monochrome mode, causes the switching mechanism to shift the developing rollers from the all-color contact state to the all-color non-contact state to perform a transferring process to once transfer developing agents from recovery members onto the corresponding photosensitive members and further transfer the developing agents from the photosensitive members onto a transfer belt.

20 Claims, 7 Drawing Sheets

IMAGE FORMING APPARATUS

CROSS REFERENCE TO RELATED APPLICATION

This application claims priority to Japanese Patent Application No. 2007-166675 filed on Jun. 25, 2007, the disclosure of which is hereby incorporated into the present application by reference.

TECHNICAL FIELD

The present invention relates to an image forming apparatus such as a color laser printer.

BACKGROUND

Image forming apparatuses capable of forming a color image on a sheet generally include photosensitive members for yellow, magenta, cyan and black, and developing rollers for supplying color toners to the corresponding photosensitive members. In image formation, the toners are respectively supplied from the developing rollers to the photosensitive members, whereby toner images of the respective colors are formed substantially at the same time. In the case of a direct transfer system, the color toner images are transferred from the respective photosensitive members onto a sheet in superposed relation, whereby the formation of the color image on the sheet is achieved. In the case of an intermediate transfer system, the color toner images are once transferred from the respective photosensitive members onto an intermediate transfer belt in superposed relation to form a color toner image on the intermediate transfer belt, and the color toner image is further transferred from the intermediate transfer belt onto a sheet, whereby the formation of the color image on the sheet is achieved.

The toners are each partly untransferred onto the sheet or the intermediate transfer belt, and remain on the corresponding photosensitive member. Therefore, a recovery roller is provided in association with the photosensitive member for recovering the toner remaining on the photosensitive member, and a predetermined recovery bias is applied to the recovery roller. The toner remaining on the photosensitive member is transferred onto the recovery roller from the photosensitive member by static electricity when being brought into opposed relation to the recovery roller.

The toner transferred onto the recovery roller is electrostatically adsorbed on the recovery roller to be accumulated on the recovery roller. If the toner is accumulated in an increased amount on the recovery roller, the recovery roller fails to electrostatically adsorb all the transferred toner, and some of the toner is released (returned) from the recovery roller onto the photosensitive member. Even if the toner is accumulated in a smaller amount on the recovery roller, a very small amount of the toner is released from the recovery roller onto the photosensitive member.

Since a bias is applied to the developing roller, the toner released from the recovery roller onto the photosensitive member is transferred onto the developing roller when being brought into opposed relation to the developing roller with the developing roller kept in contact with the photosensitive member. Therefore, even if the toner is released from the recovery roller onto the photosensitive member, there is no possibility that the toner is transferred onto the sheet or the intermediate transfer belt.

However, if the developing roller is spaced from the photosensitive member, the toner released from the recovery roller onto the photosensitive member is not transferred onto the developing roller, but transferred onto the sheet or the intermediate transfer belt. For example, some of the color image forming apparatuses are constructed such that, when a monochrome image is to be formed on a sheet, the yellow, magenta and cyan photosensitive members are kept apart from the corresponding developing rollers. In such image forming apparatuses, if the toners are released onto the yellow, magenta and cyan photosensitive members from the corresponding recovery rollers during the formation of the monochrome image, the released toner is disadvantageously transferred onto the sheet formed with the monochrome image.

SUMMARY

One aspect of the present invention may provide an image forming apparatus which is constructed such that a monochrome image forming process is performed with non-black color photosensitive members kept apart from corresponding developing rollers, and capable of preventing non-black color developing agents from being transferred onto a transfer object.

The same or different aspect of the present invention may provide an image forming apparatus operative in a monochrome mode in which a monochrome image is formed from a black developing agent image and in a color mode in which a color image is formed by superposing images of developing agents of different colors including black and non-black colors, the apparatus including: photosensitive members provided for the respective colors; developing rollers respectively provided in association with the photosensitive members in such a manner as to be brought into and out of contact with the corresponding photosensitive members, and adapted to supply the developing agents to the corresponding photosensitive members in contact with the corresponding photosensitive members to develop electrostatic latent images respectively formed on the photosensitive members into the developing agent images; a transfer belt disposed in opposed relation to the respective photosensitive members, and adapted to transfer the developing agent images respectively carried on the photosensitive members onto a transfer object; recovery members respectively provided in association with the photosensitive members, and adapted to recover parts of the developing agents remaining on the corresponding photosensitive members after the developing agent images are transferred onto the transfer object; a cleaning member which removes the developing agents from the transfer belt; a switching mechanism which selectively shifts the developing rollers among an all-color non-contact state in which all the photosensitive members are kept apart from the corresponding developing rollers, a black contact state in which the photosensitive member for black is kept in contact with the corresponding developing roller and the other photosensitive members are kept apart from the corresponding developing rollers, and an all-color contact state in which all the photosensitive members are kept in contact with the corresponding developing rollers; and a control section which, when an operation mode of the apparatus is shifted from the color mode to the monochrome mode, causes the switching mechanism to shift the developing rollers from the all-color contact state to the all-color non-contact state to perform a transferring process to once transfer the developing agents recovered on the respective recovery members onto the corresponding photosensitive members and further transfer the developing agents from the photosensitive members onto the transfer belt.

One or more aspects of the present invention provide an image forming apparatus operative in a monochrome mode in which a monochrome image is formed from a black developing agent image and in a color mode in which a color image is formed by superposing images of developing agents of different colors including black, the apparatus including: photosensitive members provided for the respective colors; developing rollers respectively provided in association with the photosensitive members in such a manner as to be brought into and out of contact with the corresponding photosensitive members, and adapted to supply the developing agents to the corresponding photosensitive members in contact with the corresponding photosensitive members to develop electrostatic latent images respectively formed on the photosensitive members into the developing agent images; a transfer belt disposed in opposed relation to the respective photosensitive members, and adapted to transfer the developing agent images respectively carried on the photosensitive members onto a transfer object; recovery members respectively provided in association with the photosensitive members, and adapted to recover parts of the developing agents remaining on the corresponding photosensitive members after the developing agent images are transferred onto the transfer object; a cleaning member which removes the developing agents from the transfer belt; a switching mechanism which selectively shifts the developing rollers between a black contact state in which the photosensitive member for black is kept in contact with the corresponding developing roller and the other photosensitive members are kept apart from the corresponding developing rollers and an all-color contact state in which all the photosensitive members are kept in contact with the corresponding developing rollers; and a control section which, when an operation mode of the apparatus is shifted from the color mode to the monochrome mode, causes the switching mechanism to shift the developing rollers from the all-color contact state to the black contact state to perform a transferring process to once transfer at least the non-black color developing agents recovered on the corresponding recovery members onto the corresponding photosensitive members and further transfer the developing agents from the corresponding photosensitive members to the transfer belt.

One or more aspects of the present invention provide an image forming apparatus operative in a monochrome mode in which a monochrome image is formed from a black developing agent image and in a color mode in which a color image is formed by superposing images of developing agents of different colors including black, the apparatus including: photosensitive members provided for the respective colors; developing rollers respectively provided in association with the photosensitive members in such a manner as to be brought into and out of contact with the corresponding photosensitive members, and adapted to supply the developing agents to the corresponding photosensitive members in contact with the corresponding photosensitive members to develop electrostatic latent images respectively formed on the photosensitive members into the developing agent images; a transfer belt disposed in opposed relation to the respective photosensitive members, and adapted to transfer the developing agent images respectively carried on the photosensitive members onto a transfer object; recovery members respectively provided in association with the photosensitive members, and adapted to recover parts of the developing agents remaining on the corresponding photosensitive members after the developing agent images are transferred onto the transfer object; a switching mechanism which selectively shifts the developing rollers between a black contact state in which the photosensitive member for black is kept in contact with the corresponding developing roller and the other photosensitive members are kept apart from the corresponding developing rollers and an all-color contact state in which all the photosensitive members are kept in contact with the corresponding developing rollers; and a control section which, when an operation mode of the apparatus is shifted from the color mode to the monochrome mode, performs a transferring process to once transfer the developing agents recovered on the respective recovery members onto the corresponding photosensitive members and further transfer the developing agents from the photosensitive members to the corresponding developing rollers before the switching mechanism shifts the developing rollers from the all-color contact state to the black contact state.

DETAILED DESCRIPTION

Embodiments of the present invention will hereinafter be described with reference to the attached drawings.

First Embodiment

1. Overall Construction

Figure 1:
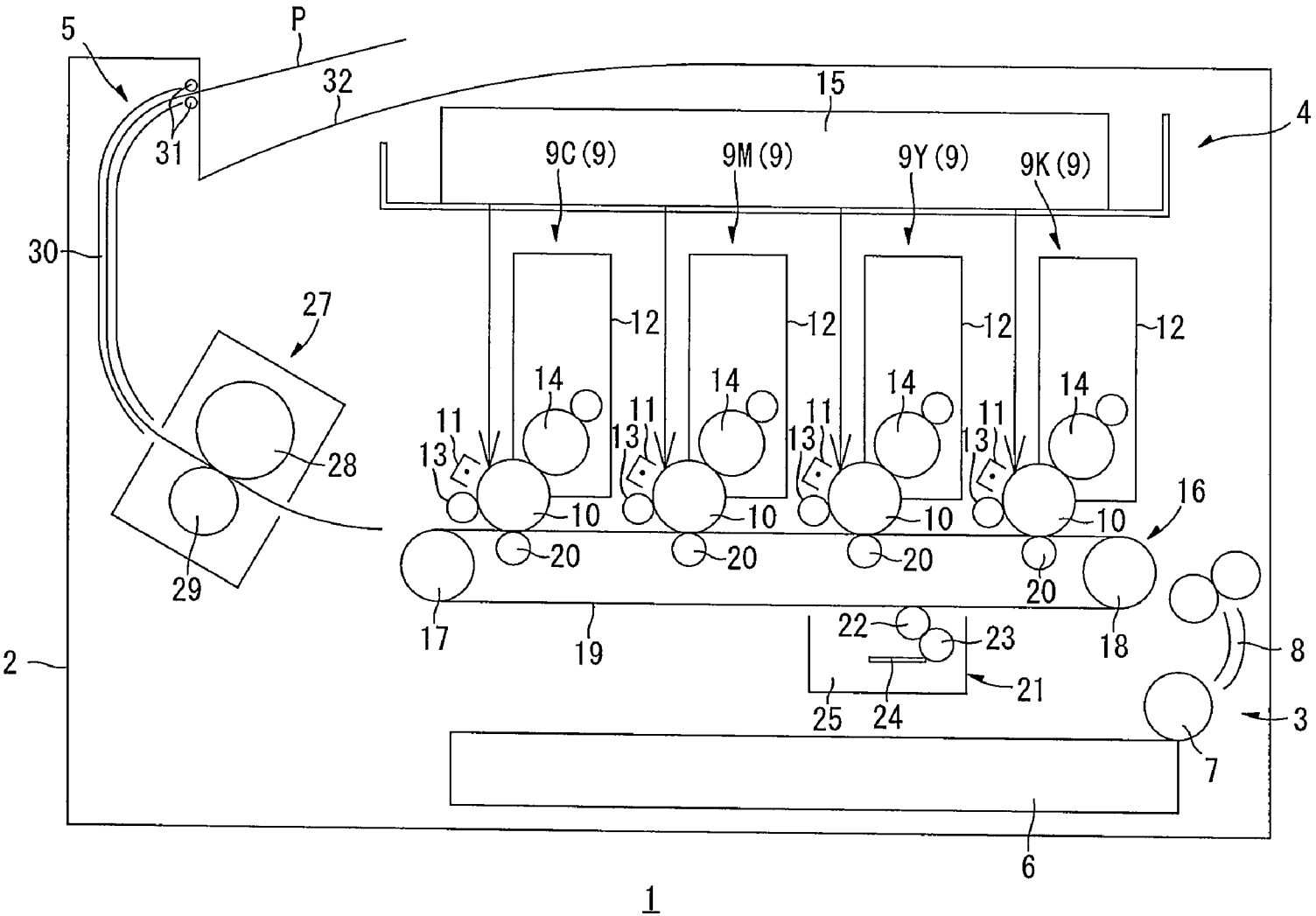
FIG. 1 is a side sectional view schematically illustrating the construction of a color laser printer as an example of an image forming apparatus according to the present invention.

FIG. 1 is a side sectional view schematically illustrating the construction of a color laser printer as an example of an image forming apparatus according to the present invention.

The color laser printer 1 is a tandem color laser printer. The color laser printer 1 includes a sheet feeding section 3 for feeding a sheet P (an example of an object onto which an image is transferred), an image forming section 4 for forming an image on the sheet P fed thereto, and a sheet ejecting section 5 for ejecting the sheet P formed with the image, which are provided in a box-shaped main body casing 2 thereof.

(1) Sheet Feeding Section

The sheet feeding section 3 includes a sheet feeding tray 6 in which sheets P are stored in a stacked state, and a sheet feeding roller 7 which feeds out the sheets P one by one from the sheet feeding tray 6. The sheet P fed out of the sheet feeding tray 6 is transported through a sheet transport path 8 toward the image forming section 4.

(2) Image Forming Section

The image forming section 4 includes a black processing unit 9K, a yellow processing unit 9Y, a magenta processing unit 9M and a cyan processing unit 9C. The black processing unit 9K, the yellow processing unit 9Y, the magenta processing unit 9M and the cyan processing unit 9C are arranged in this order in a sheet transport direction in which the sheet P is transported.

In the following description, the black processing unit 9K, the yellow processing unit 9Y, the magenta processing unit 9M and the cyan processing unit 9C are generally referred to as "processing units 9" if there is no need to discriminate these processing units 9K, 9Y, 9M, 9C from one another.

The processing units 9 each include a photosensitive drum 10 (an example of a photosensitive member), a charger 11, a developing device 12 and a recovery member 13.

The photosensitive drum 10 has a cylindrical shape. The photosensitive drum 10 has a positively chargeable photosensitive outermost layer formed by employing polycarbonate or the like as a binder. In an image forming process, the photosensitive drum 10 is driven to be rotated in a predetermined direction (clockwise in FIG. 1).

The charger 11 is, for example, a scorotron charger of a positively charging type. The charger 11 includes a wire and a grid, and is adapted to generate a corona discharge by application of a charging bias.

The developing device 12 is disposed downstream of the charger 11 with respect to the direction of the rotation of the photosensitive drum 10. The developing device 12 contains a toner of each color, and includes a developing roller 14 for feeding the toner onto a surface of the photosensitive drum 10.

The developing roller 14 has a structure such that a metal shaft is coated with an electrically conductive rubber material. The developing roller 14 extends parallel to a center axis of the photosensitive drum 10 with its circumferential surface in contact with the surface of the photosensitive drum 10. In the image forming process, a developing bias is applied to the developing roller 14.

The recovery member 13 is a roller having a structure such that a metal shaft is coated with an electrically conductive rubber material. The recovery member 13 extends parallel to the center axis of the photosensitive drum 10 with its circumferential surface in contact with the surface of the photosensitive drum 10. A recovery bias is applied to the recovery member 13.

In the image forming process (developing process), the photosensitive drum 10 is driven to be rotated. As the photosensitive drum 10 is rotated, the surface of the photosensitive drum 10 is uniformly positively charged through the corona discharge generated by the charger 11. Then, the positively charged surface of the photosensitive drum 10 is scanned at a high speed to be exposed to a laser beam applied from an exposing device 15, whereby an electrostatic latent image for each color is formed on the surface of the photosensitive drum 10 as corresponding to an image to be formed on the sheet P. The electrostatic latent image is developed (made visible) into a toner image by supplying the toner from the developing roller 14.

The exposing device 15 includes an LED array, which may be incorporated in each of the processing units 9, or may be provided above the image forming section 4 as a scanner unit including a light source and a polygonal mirror.

A transfer section 16 for transferring the toner images from the surfaces of the photosensitive drums 10 onto the sheet P is disposed below the four processing units 9.

The transfer section 16 includes a driving roller 17, a driven roller 18 disposed upstream of the driving roller 17 with respect to the sheet transport direction in opposed relation to the driving roller 17, and an endless transport belt 19 (an example of a transfer belt) stretched between the driving roller 17 and the driven roller 18. The driving roller 17, the driven roller 18 and the transport belt 19 are located so that a surface of an upper portion of the transport belt 19 is kept in contact with the respective photosensitive drums 10. The driving roller 17 is rotated in a direction opposite to the direction of the rotation of the photosensitive drum 10 (counterclockwise in FIG. 1) by a driving force applied from a motor (not shown). As the driving roller 17 is rotated, the transport belt 19 is circularly driven in the same direction as the driving roller 17 to rotate the driven roller 18.

The transfer section 16 includes transfer rollers 20 respectively disposed in opposed relation to the photosensitive drums 10 with the intervention of the transport belt 19, and a cleaning unit 21 (an example of a cleaning member) opposed to a lower portion of the transport belt 19 from a lower side thereof.

The sheet P transported into the image forming section 4 from the sheet feeding section 3 is fed onto the transport belt 19, and transported by circular movement of the transport belt 19 to sequentially pass through contact portions between the transport belt 19 and the respective photosensitive drums 10. During the transport, the toner images carried on the respective photosensitive drums 10 are transferred onto the sheet P by a transfer bias applied to the transfer rollers 20. After the image transfer, toner remaining on each of the photosensitive drums 10 is transferred onto the recovery member 13 by a static electricity when being brought into contact with the recovery member 13. The toner transferred onto the recovery member 13 is accumulated on a circumferential surface of the recovery member 13 through electrostatic adsorption.

The cleaning unit 21 includes a primary cleaning roller 22, a secondary cleaning roller 23, a urethane blade 24 and a storage container 25.

The primary cleaning roller 22 extends horizontally (widthwise of the transport belt 19) and perpendicularly to the direction of the movement of the transport belt 19 with its circumferential surface in contact with a surface (lower surface) of the lower portion of the transport belt 19. The primary cleaning roller 22 has a structure such that a shaft of an electrically conductive material (e.g., an iron shaft plated with Ni or a stainless steel shaft) is coated with a foamed silicone material. The primary cleaning roller 22 is driven to be rotated in the same direction as the direction of the circular movement of the transport belt 19 (counterclockwise in FIG. 1).

The secondary cleaning roller 23 extends parallel to the primary cleaning roller 22 in contact with the circumferential surface of the primary cleaning roller 22. The secondary cleaning roller 23 is a rod member (shaft) of an electrically conductive material such as iron.

A primary cleaning bias is applied to the primary cleaning roller 22, while a secondary cleaning bias is applied to the secondary cleaning roller 23. This produces potential differences between the transport belt 19 and the primary cleaning roller 22 and between the primary cleaning roller 22 and the secondary cleaning roller 23. Substances present on the transport belt 19 are transferred onto the primary cleaning roller 22 by the potential difference between the transport belt 19 and the primary cleaning roller 22. The substances transferred onto the primary cleaning roller 22 are further transferred from the primary cleaning roller 22 onto the secondary cleaning roller 23 by the potential difference between the primary cleaning roller 22 and the secondary cleaning roller 23. The substances transferred onto the secondary cleaning roller 23 are scraped off from the secondary cleaning roller 23 by the urethane blade 24 and stored in the storage container 25.

The image forming section 4 further includes a fixing section 27 for fixing the toner images transferred onto the sheet P.

The fixing section 27 includes a heating roller 28 and a pressure roller 29. The pressure roller 29 is kept in pressure contact with the heating roller 28 from the lower side. The sheet P transported by the transport belt 19 is fed to a nip between the heating roller 28 and the pressure roller 29. While the sheet P passes through the nip between the heating roller 28 and the pressure roller 29, the toner images transferred onto the sheet P are fixed on the sheet P by application of heat and pressure.

(3) Sheet Ejecting Section

The sheet ejecting section 5 includes a sheet transport path 30 having a C-shaped section which opens toward the image forming section 4. The sheet P transported from the fixing section 27 passes through the sheet transport path 30, and is ejected onto a sheet ejection tray 32 provided on an upper surface of the main body casing 2 by sheet ejecting rollers 31.

2. Construction of Major Portion

Figure 2:
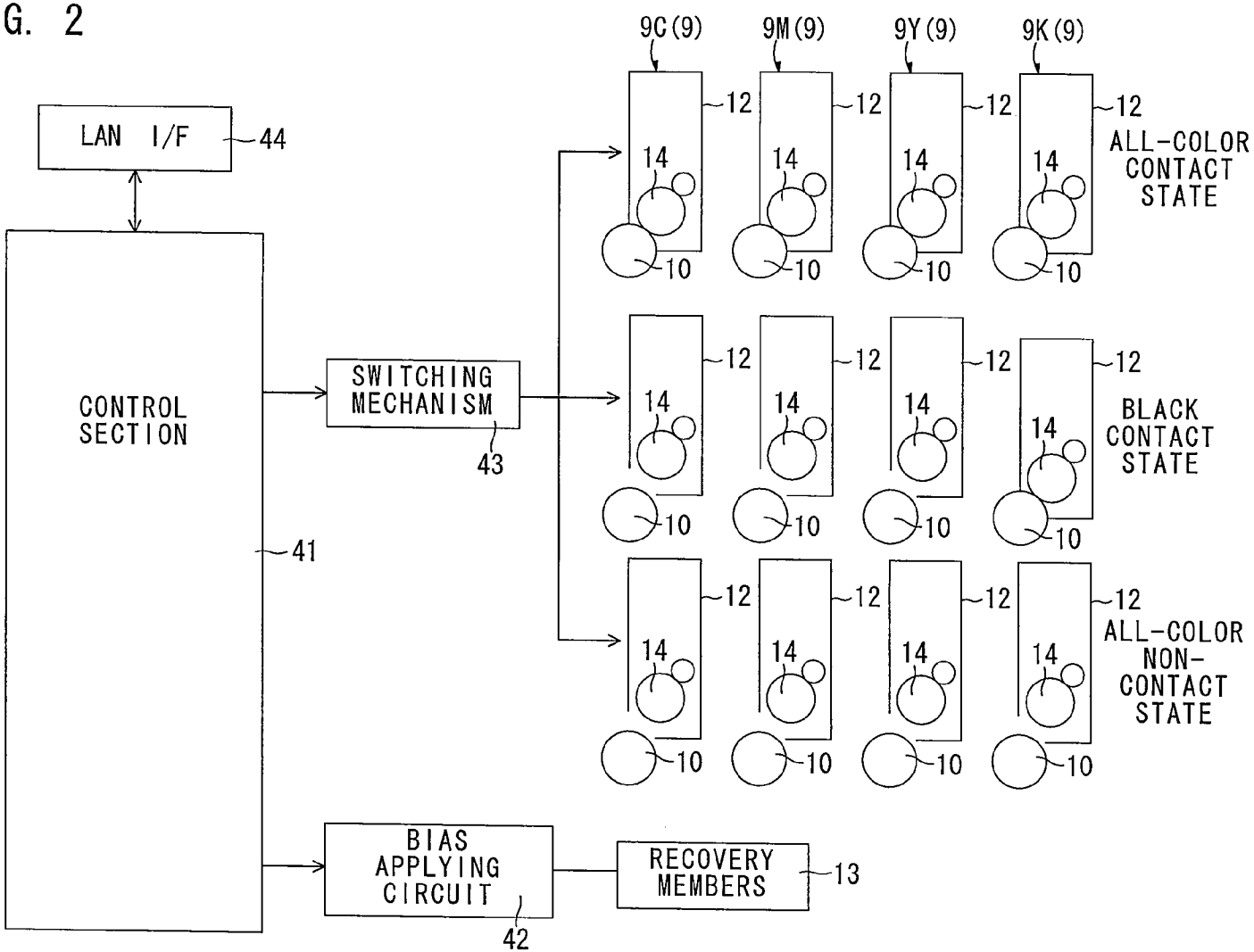
FIG. 2 is a block diagram illustrating the construction of a major portion of the color laser printer.

FIG. 2 is a block diagram illustrating the construction of a major portion of the color laser printer.

The color laser printer 1 includes a control section 41 for controlling the respective sections of the color laser printer 1. The control section 41 includes a microcomputer including a CPU, a RAM, a ROM and the like.

A bias applying circuit 42 for applying the recovery bias to the respective recovery members 13 is connected as a control object to the control section 41. The control section 41 controls the bias applying circuit 42 to apply −500 to +500 V as the recovery bias to the respective recovery members 13 from the bias applying circuit 42.

In the color laser printer 1, the developing devices 12 are movable with respect to the corresponding photosensitive drums 10. The color laser printer 1 further includes a switching mechanism 43 for switching the contact/non-contact states of the four developing rollers 14 with respect to the corresponding photosensitive drums 10. The switching mechanism 43 is connected as a control object to the control section 41. The control section 41 controls the switching mechanism 43 to shift the developing devices 12 among an all-color non-contact state in which all the photosensitive drums 10 are kept apart from the corresponding developing rollers 14, a black contact state in which the photosensitive drum 10 of the black processing unit 9K is kept in contact with the corresponding developing roller 14 and the other photosensitive drums 10 are kept apart from the corresponding developing rollers 14, and an all-color contact state in which all the photosensitive drums 10 are kept in contact with the corresponding developing rollers 14. It is noted that the all-color non-contact state is not necessarily required, but the developing devices 12 may be shifted between the black contact state and the all-color contact state.

A LAN interface (LAN I/F) 44 for connection to a LAN (Local Area Network) is connected to the control section 41. The control section 41 receives, for example, print data (image data) transmitted from a personal computer connected to the LAN via the LAN interface 44. Then, the control section 41 controls the respective sections of the color laser printer 1 on the basis of the received print data, whereby a color image or a monochrome image is formed on a sheet P based on the print data.

3. Main Routine

Figure 3:
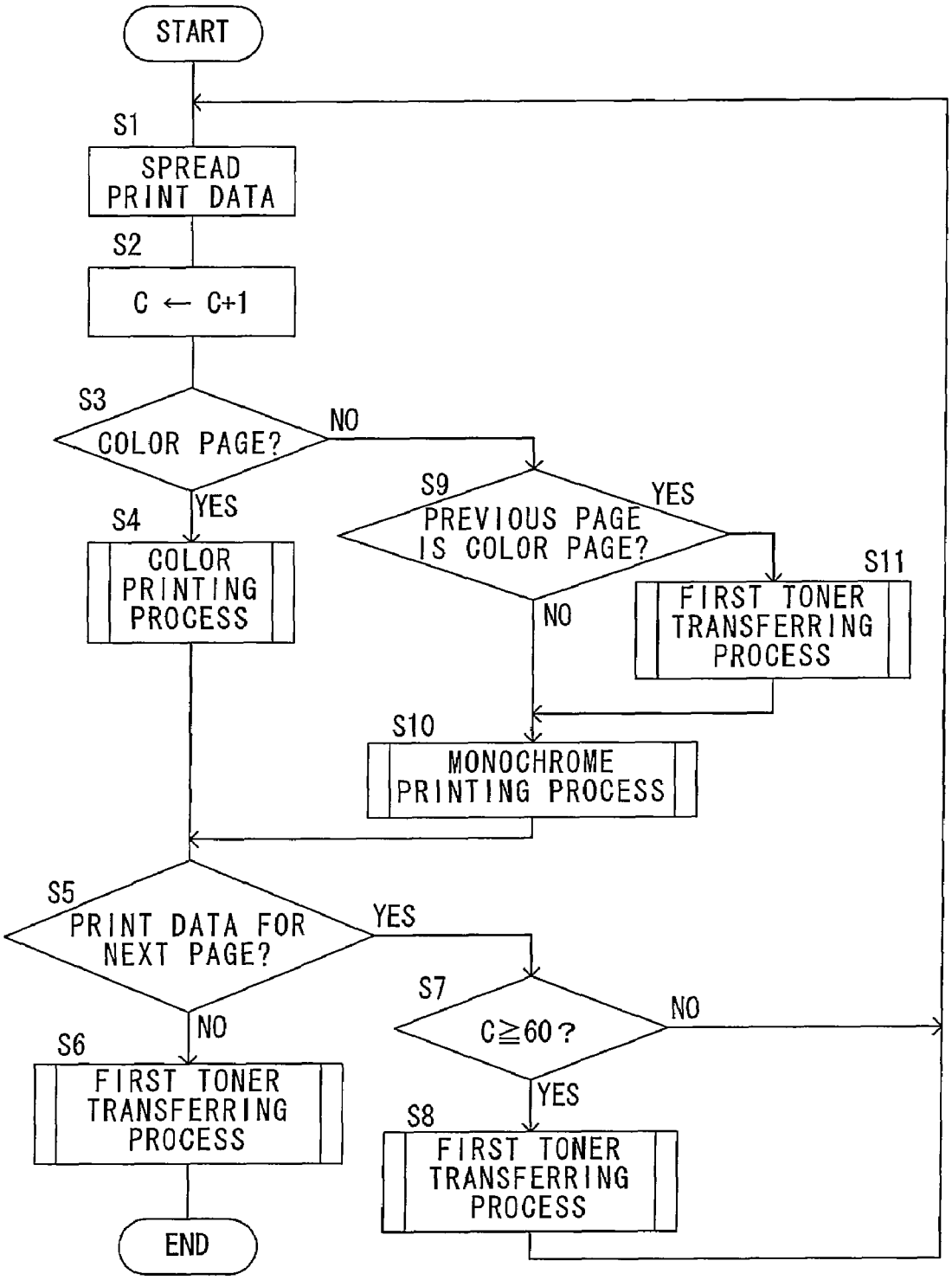
FIG. 3 is a flow chart showing a main routine for a printing operation.

FIG. 3 is a flow chart showing a main routine for a printing operation.

For example, a command for starting the printing operation is transmitted to the control section 41 from the personal computer before the transmission of the print data. Upon reception of the command, the control section 41 calls a main routine shown in FIG. 3.

The print data is transmitted on the basis of an image unit to be formed on a single sheet P (on a page basis). When the control section 41 receives the print data, the print data is spread on a bit map memory not shown (Step S1).

When the single-page print data is spread on the bit map memory, the count C of a page counter provided in the RAM is incremented (+1) (Step S2).

In turn, it is checked whether or not the print data spread on the bit map memory is color page data, i.e., whether the print data is color image data or monochrome image data (Step S3).

If the print data spread on the bit map memory is color page data (color image data) (YES in Step S3) a color printing process is performed (Step S4). In the color printing process, the printer operates in a color mode for color image formation on the sheet P, and the switching mechanism 43 is controlled to shift the developing devices 12 into the all-color contact state in which all the photosensitive drums 10 are kept in contact with the corresponding developing rollers 14. However, if the developing rollers 14 are already in the all-color contact state, the developing devices 12 are not shifted. Thereafter, color toner images are formed on the respective photosensitive drums 10, and transferred onto the sheet P in superposed relation. Thus, a color toner image is formed on the sheet P. Then, the color toner image is fixed on the sheet P by application of heat and pressure, whereby formation of a color image on the sheet P (the printing of a color page) is achieved.

After the color printing process is performed, it is checked whether print data for the next page is received (Step S5).

If no next page print data is received (NO in Step S5), a first toner transferring process to be described later is performed (Step S6), and the program routine ends.

On the other hand, if print data for the next page is received (YES in Step S5), it is judged whether the count C of the page counter satisfies C≧60 (Step S7).

After the completion of the printing of the first page, the count C is C=1. Therefore, the count C does not satisfy C≧60 (NO in Step S7). In this case, the routine returns to Step S1, and print data for the second page is spread on the bit map memory.

After the color printing process is continuously performed to print 60 color pages by repeating Steps S1 to S5 and S7 in the aforesaid manner, for example, the count C of the page counter reaches 60. If print data for the 61st page is received (YES in Step S5), the count C satisfies C≧60 in Step S7. In this case, the first toner transferring process to be described later is performed (Step S8), and then the routine returns to Step S1 to spread the print data for the 61st page on the bit map memory.

If the print data spread on the bit map memory is monochrome page (monochrome image) data (NO in Step S3), it is judged whether a page printed immediately therebefore is a color page (Step S9). Where the print data spread on the bit map memory is print data for the first page, no page is printed therebefore and, hence, the judgment is negative (NO in Step S9).

If the judgment on whether the page printed immediately therebefore is a color page is negative, a monochrome printing process is performed (Step S10). In the monochrome printing process, the printer operates in a monochrome mode for monochrome image formation on a sheet P, and the switching mechanism 43 is controlled to shift the developing devices 12 into the black contact state in which the photosensitive drum 10 of the black processing unit 9K is kept in contact with the corresponding developing roller 14 and the other photosensitive drums 10 are kept apart from the corresponding developing rollers 14. However, if the developing devices 12 are already in the black contact state, the developing devices 12 are not shifted. Thereafter, a black toner image is formed on the photosensitive drum 10 of the black processing unit 9K, and transferred onto the sheet P. Then, the black toner image is fixed on the sheet P by application of heat and pressure, whereby formation of a monochrome image on the sheet P (the printing of a monochrome page) is achieved.

On the other hand, if the monochrome page printing follows the color page printing, the judgment on whether the page printed immediately therebefore is a color page is positive (YES in Step S9). In this case, the first toner transferring process to be described later is performed (Step S11), and then the monochrome printing process is performed (Step S10).

After the monochrome printing process is performed, it is judged whether print data for the next page is received (Step S5) as in the case of the color printing process, and the aforementioned process sequence following Step S5 is performed.

4. First Toner Transferring Process

Figure 4:
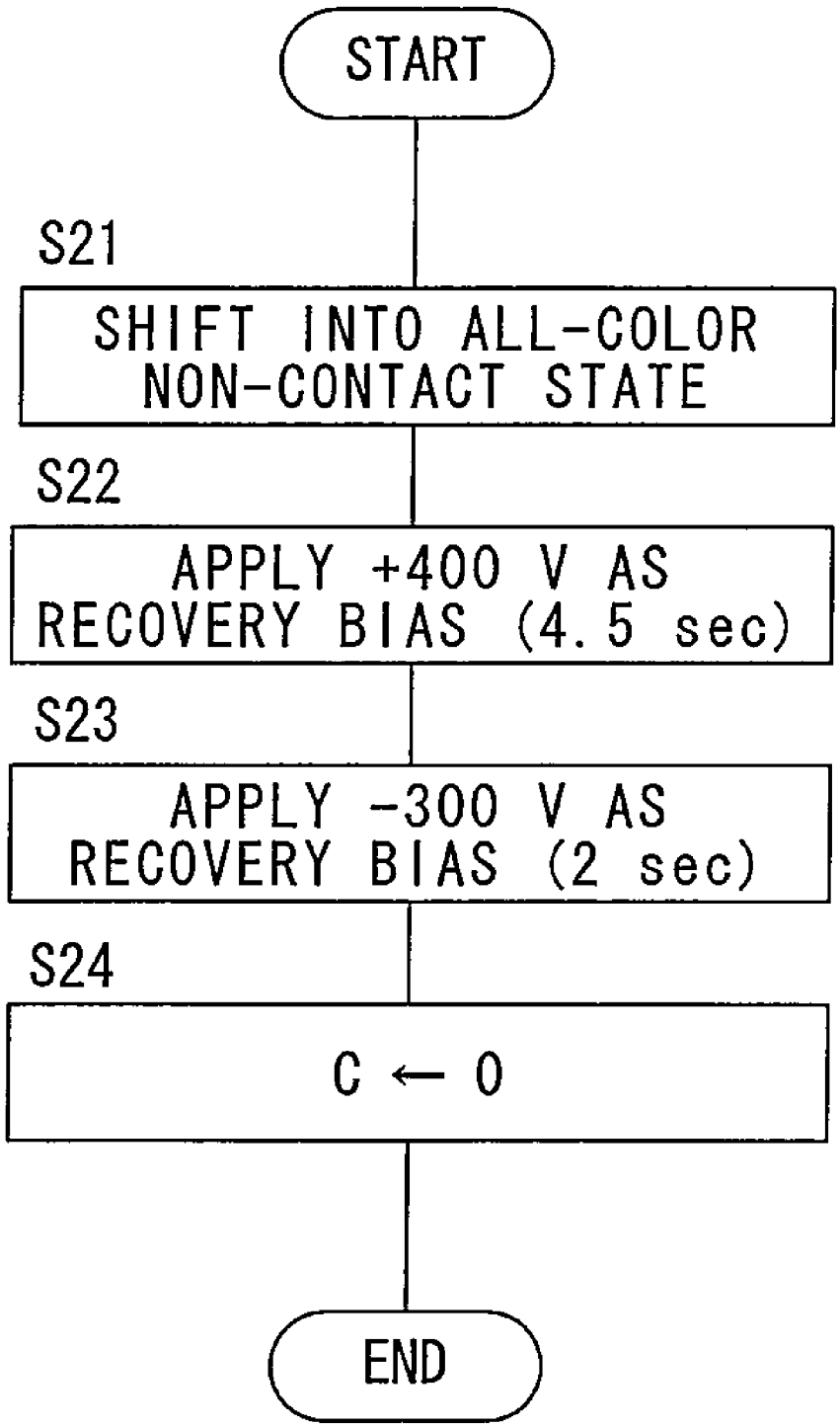
FIG. 4 is a flow chart showing a first toner transferring process.

FIG. 4 is a flow chart showing the first toner transferring process.

In the first toner transferring process to be performed in Steps S6, S8, S11 shown in FIG. 3, the switching mechanism 43 is controlled to shift the developing devices 12 from the all-color contact state to the all-color non-contact state in which all the photosensitive drums 10 are kept apart from the corresponding developing rollers 14 (Step S21). Then, the photosensitive drums 10 are driven to be rotated, and the transport belt 19 is circularly moved with the developing devices 12 kept in the all-color non-contact state.

Subsequently, the bias applying circuit 42 is controlled to apply +400 V as the recovery bias to the respective recovery members 13 (Step S22). The application of the recovery bias increases the potentials of the recovery members 13 to a level higher than the potentials of the photosensitive drums 10, so that greater potential differences occur between the photosensitive drums 10 and the recovery members 13. With the potential differences, the toners accumulated on the respective recovery members 13 are released (transferred) from the recovery members 13 onto the surfaces of the corresponding photosensitive drums 10. Since the photosensitive drums 10 are spaced from the corresponding developing rollers 14, the toners released onto the surfaces of the photosensitive drums 10 are not recovered on the developing rollers 14, but transferred onto the transport belt 19 from the respective photosensitive drums 10 when being brought into opposed relation to the transport belt 19. The toners transferred onto the transport belt 19 are removed by the cleaning unit 21 when being brought into opposed relation to the cleaning unit 21.

If the sheet P is fed onto the transport belt 19 when the toners are transferred from the respective photosensitive drums 10 onto the transport belt 19, the toners would adhere onto the sheet P. Therefore, the operation of the sheet feeding section 3 is interrupted during the application of +400 V as the recovery bias to the respective recovery members 13.

A period (hereinafter referred to as "recovery bias application period) during which +400 V is applied as the recovery bias to the recovery members 13 (or the operation of the sheet feeding section 3 is interrupted) is preferably not shorter than a period required for the toner released from the recovery member 13 of the yellow processing unit 9Y (which is the most upstream one of the non-black color processing units 9 with respect to the sheet transport direction) onto the corresponding photosensitive drum 10 to be transferred onto the transport belt 19. By thus setting the recovery bias application period, the toners (yellow, magenta and cyan toners) released from the recovery members 13 of the non-black color processing units 9 onto the corresponding photosensitive drums 10 are prevented from adhering onto the sheet P.

Further, the recovery bias application period is preferably not shorter than a period required for the cleaning unit 21 to remove the toner released from the recovery member 13 of the yellow processing unit 9Y onto the corresponding photosensitive drum 10. By thus setting the recovery bias application period, the yellow, magenta and cyan toners are reliably prevented from adhering onto the sheet P. In view of this, the recovery bias application period is set to 4.5 seconds in the first embodiment.

After +400 V is applied as the recovery bias to the respective recovery members 13 for the recovery bias application period, the bias applying circuit 42 is controlled to apply a predetermined level of recovery bias to the respective recovery members 13 for two seconds (Step S23). The recovery bias to be applied at this time is determined according to the use environment and the like so that the toners remaining on the photosensitive drums 10 can be recovered on the corresponding recovery members 13 and, for example, set at −300 V. Even if the toners remain on the surfaces of the respective photosensitive drums 10, the toners can be recovered on the recovery members 13.

Thereafter, the count C of the page counter is reset to zero (Step S24), and the first toner transferring process ends.

5. Effects

When the monochrome page printing process is performed after the color page printing process, i.e., when the operating mode of the printer is shifted from the color mode to the monochrome mode, the first toner transferring process shown in FIG. 4 is performed prior to the monochrome page printing process (for the monochrome image formation on the sheet P). In the first toner transferring process, the developing devices 12 are shifted from the all-color contact state in which all the photosensitive drums 10 are kept in contact with the corresponding developing rollers 14 to the all-color non-contact state in which all the photosensitive drums 10 are kept apart from the corresponding developing rollers 14. With the developing devices 12 kept in the all-color non-contact state, the toners recovered (accumulated) on the respective recovery members 13 are once transferred onto the photosensitive drums 10, and further transferred onto the transport belt 19 from the photosensitive drums 10. Thus, the recovery members 13 are cleaned (or the toners are released from the respective recovery members 13). Therefore, when the monochrome page printing process is thereafter performed with the developing devices 12 kept in the black contact state in which the photosensitive drum 10 of the black processing unit 9K is kept in contact with the corresponding developing roller 14 and the other photosensitive drums 10 are kept apart from the corresponding developing rollers 14, the toners are not released from the recovery members 13 of the yellow processing unit 9Y, the magenta processing unit 9M and the cyan processing unit 9C onto the corresponding photosensitive drums 10, so that the transfer of the yellow, magenta and cyan toners on the sheet P can be prevented.

The transfer of the toners from the recovery members 13 onto the photosensitive drums 10 is achieved by producing the potential differences between the photosensitive drums 10 and the recovery members 13. In the color laser printer 1, the control section 41 controls the bias applying circuit 42 to apply the recovery bias to the recovery members 13 for transferring the toners onto the photosensitive drums 10 from the corresponding recovery members 13. This produces the potential differences between the photosensitive drums 10 and the recovery members 13, whereby the toners are transferred from the recovery members 13 onto the photosensitive drums 10.

The potential differences between the photosensitive drums 10 and the recovery members 13 for transferring the toners from the recovery members 13 onto the photosensitive drums 10 may be produced by controlling the potentials of the respective photosensitive drums 10 through exposure of the photosensitive drums 10 to light.

Second Embodiment

1. Main Routine

Figure 5:
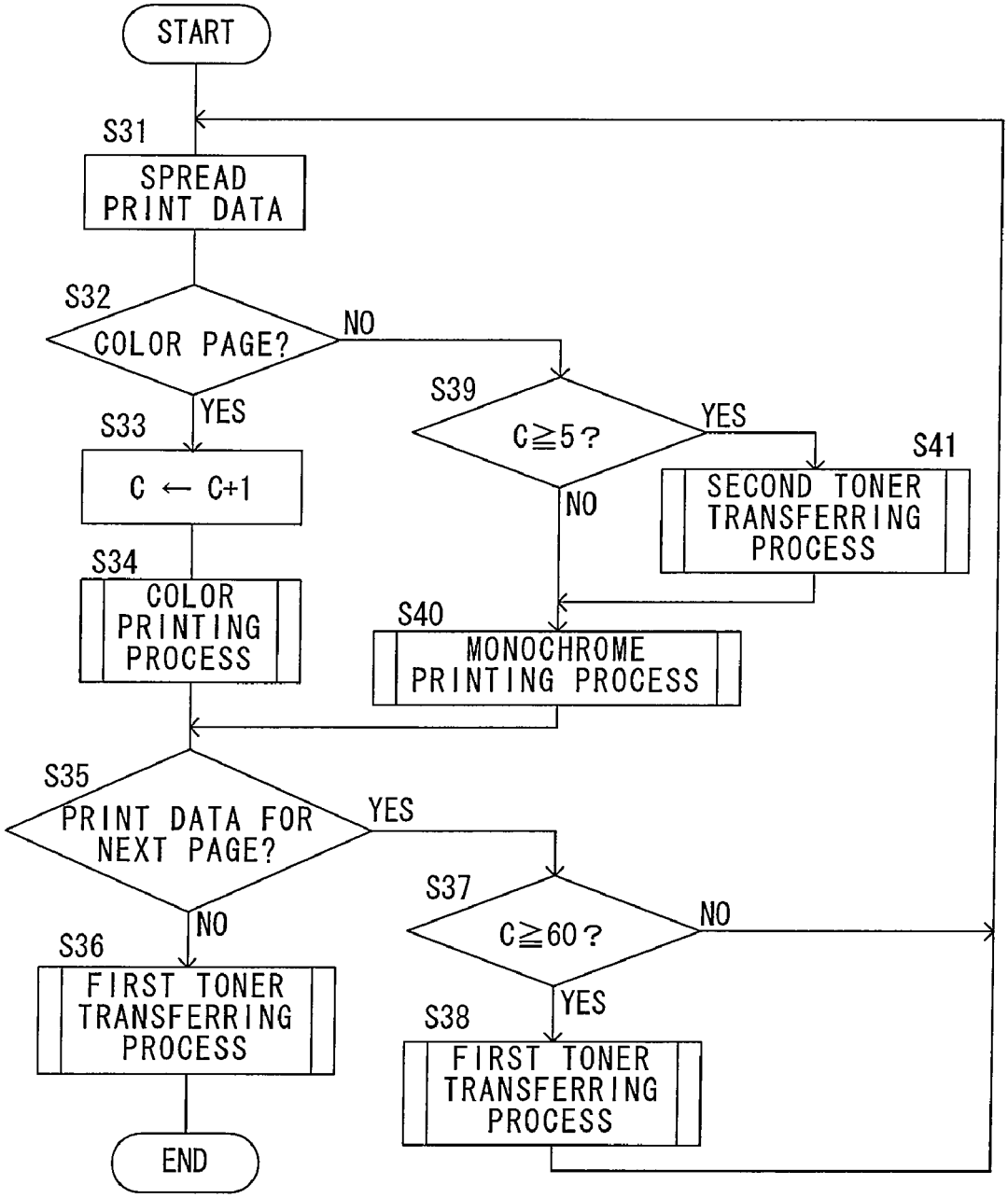
FIG. 5 is a flow chart for explaining another main routine for the printing operation.

FIG. 5 is a flow chart for explaining another main routine for the printing operation.

For example, a command for starting the printing operation is transmitted to the control section 41 from the personal computer before the transmission of print data. Upon reception of the command, the control section 41 calls the main routine shown in FIG. 5.

The print data is transmitted on the basis of an image unit to be formed on a single sheet P (on a page basis). When the control section 41 receives the print data, the print data is spread on the bit map memory not shown (Step S31).

In turn, it is checked whether or not the print data spread on the bit map memory is color page data, i.e., whether the print data is color image data or monochrome image data (Step S32).

If the print data spread on the bit map memory is color page (color image) data (YES in Step S32), the count C of the color page counter provided in the RAM is incremented (+1) (Step S33).

Then, the color printing process is performed (Step S34).

After the color printing process is performed, it is checked whether print data for the next page is received (Step S35).

If no next page print data is received (NO in Step S35), the first toner transferring process shown in FIG. 4 is performed (Step S36), and the program routine ends.

On the other hand, if print data for the next page is received (YES in Step S35), it is judged whether the count C of the color page counter satisfies C≧60 (Step S37).

After the completion of the printing of the first color page, the count C is C=1. Therefore, the count C does not satisfy C≧60 (NO in Step S37). In this case, the routine returns to Step S31, and print data for the second page is spread on the bit map memory.

After the color printing process is continuously performed to print 60 color pages by repeating Steps S31 to S35 and S37 in the aforesaid manner, for example, the count C of the color page counter reaches 60. If print data for the 61st page is received (YES in Step S35), the count C satisfies C≧60 in Step S37. In this case, the first toner transferring process shown in FIG. 4 is performed (Step S38), and then the routine returns to Step S31 to spread the print data for the 61st page on the bit map memory.

If the print data spread on the bit map memory is monochrome page (monochrome image) data (NO in Step S32), it is judged whether the count C of the color page counter satisfies C≧5 (Step S39).

If the count C does not satisfy C≧5 (NO in Step S39), the monochrome printing process is performed (Step S40).

On the other hand, if the count C satisfies C≧5 (YES in Step S39), a second toner transferring process to be described later is performed (Step S41), and then the monochrome printing process is performed (Step S40).

After the monochrome printing process is performed, it is judged whether print data for the next page is received (Step S35) as in the case of the color printing process, and the aforementioned process sequence following Step S35 is performed.

2. Second Toner Transferring Process

Figure 6:
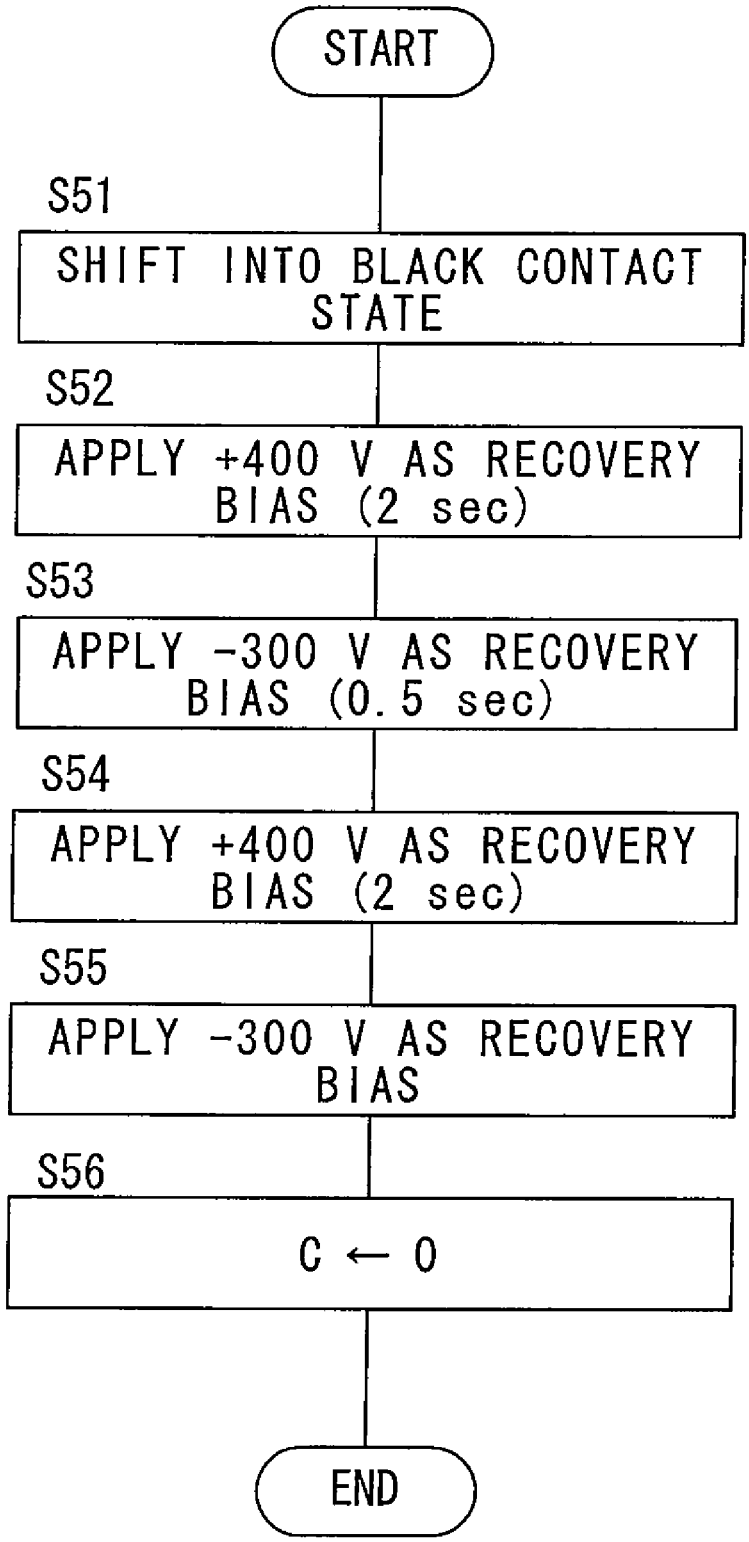
FIG. 6 is a flow chart showing a second toner transferring process.

FIG. 6 is a flow chart showing the second toner transferring process.

In the second toner transferring process to be performed in Steps S41 shown in FIG. 5, the switching mechanism 43 is controlled to shift the developing devices 12 from the all-color contact state to the black contact state in which the photosensitive drum 10 of the black processing unit 9K is kept in contact with the corresponding developing roller 14 and the other photosensitive drums 10 are kept apart from the corresponding developing rollers 14 (Step S51). Then, the photosensitive drums 10 are driven to be rotated, and the transport belt 19 is circularly moved with the developing devices 12 kept in the black contact state.

Where the second embodiment is employed, the bias applying circuit 42 is adapted to apply the recovery bias to the recovery member 13 of the black processing unit 9K separately from the recovery members 13 of the yellow processing unit 9Y, the magenta processing unit 9M and the cyan processing unit 9C. After the developing devices 12 are shifted into the black contact state, the bias applying circuit 42 is controlled to apply +400 V, for example, as the recovery bias to the recovery members 13 of the yellow processing unit 9Y, the magenta processing unit 9M and the cyan processing unit 9C for two seconds (Step S52). By the application of the recovery bias, the toners accumulated on the recovery members 13 of the yellow processing unit 9Y, the magenta processing unit 9M and the cyan processing unit 9C are transferred onto the transport belt 19 from the recovery members 13 via the corresponding photosensitive drums 10. Then, the toners transferred onto the transport belt 19 are removed by the cleaning unit 21 when being brought into opposed relation to the cleaning unit 21.

Thereafter, the bias applying circuit 42 is controlled to apply −300 V, for example, as the recovery bias to the recovery members 13 of the yellow processing unit 9Y, the magenta processing unit 9M and the cyan processing unit 9C for 0.5 second (Step S53).

In turn, the recovery bias to be applied to the recovery members 13 of the yellow processing unit 9Y, the magenta processing unit 9M and the cyan processing unit 9C is set back to +400 V by controlling the bias applying circuit 42. Then, +400 V is applied as the recovery bias for 2 seconds (Step S54).

The instantaneous application of −300 V as the recovery bias to the recovery members 13 disintegrates the toners accumulated on the recovery members 13. More specifically, where the recovery members 13 are each composed of a foam material, the toners entrapped in inner cells of the foam recovery members are released on the surfaces of the recovery members. Therefore, when +400 V is thereafter applied as the recovery bias to the recovery members 13, the toners are advantageously transferred from the recovery members 13 onto the photosensitive drums 10.

Thereafter, the recovery bias to be applied to the recovery members 13 of the yellow processing unit 9Y, the magenta processing unit 9M and the cyan processing unit 9C is set to a predetermined level by controlling the bias applying circuit 42 (Step S55). The recovery bias is determined according to the use environment and the like so that the toners remaining on the photosensitive drums 10 can be recovered on the corresponding recovery members 13 and, for example, set at −300 V.

Thereafter, the count C of the page counter is reset to zero (Step S56), and the second toner transferring process ends.

3. Effects

In the second embodiment, when the monochrome page printing process is performed after five or more color pages are printed (i.e., the count C of the color page counter is incremented to not less than 5), the second toner transferring process shown in FIG. 6 is performed prior to the monochrome page printing process. In the second toner transferring process, the developing devices 12 are shifted from the all-color contact state in which all the photosensitive drums 10 are kept in contact with the corresponding developing rollers 14 to the black contact state in which the photosensitive drum 10 of the black processing unit 9K is kept in contact with the corresponding developing roller 14 and the other photosensitive drums 10 are kept apart from the corresponding developing rollers 14. With the developing devices 12 kept in the black contact state, the toners recovered on the recovery members 13 of the yellow processing unit 9Y, the magenta processing unit 9M and the cyan processing unit 9C are transferred onto the transport belt 19 via the corresponding photosensitive drums 10. Thus, the cleaning of the recovery members 13 of the yellow processing unit 9Y, the magenta processing unit 9M and the cyan processing unit 9C is achieved. Therefore, when the monochrome page printing process is performed after the second toner transferring process, the toners are not released from the recovery members 13 of the yellow processing unit 9Y, the magenta processing unit 9M and the cyan processing unit 9C onto the corresponding photosensitive drums 10, so that the transfer of the yellow, magenta and cyan toners on the sheet P can be prevented.

In the second toner transferring process, the developing devices 12 are not shifted into the all-color non-contact state in which all the photosensitive drums 10 are kept apart from the corresponding developing rollers 14, so that the time required for the process can be reduced by the time required for shifting the developing devices 12 from the all-color non-contact state to the black contact state as compared with the first toner transferring process shown in FIG. 4.

Since the developing devices 12 are kept in the black contact state in the second toner transferring process, the monochrome page printing process can be started immediately after the completion of the second toner transferring process.

Third Embodiment

Figure 7:
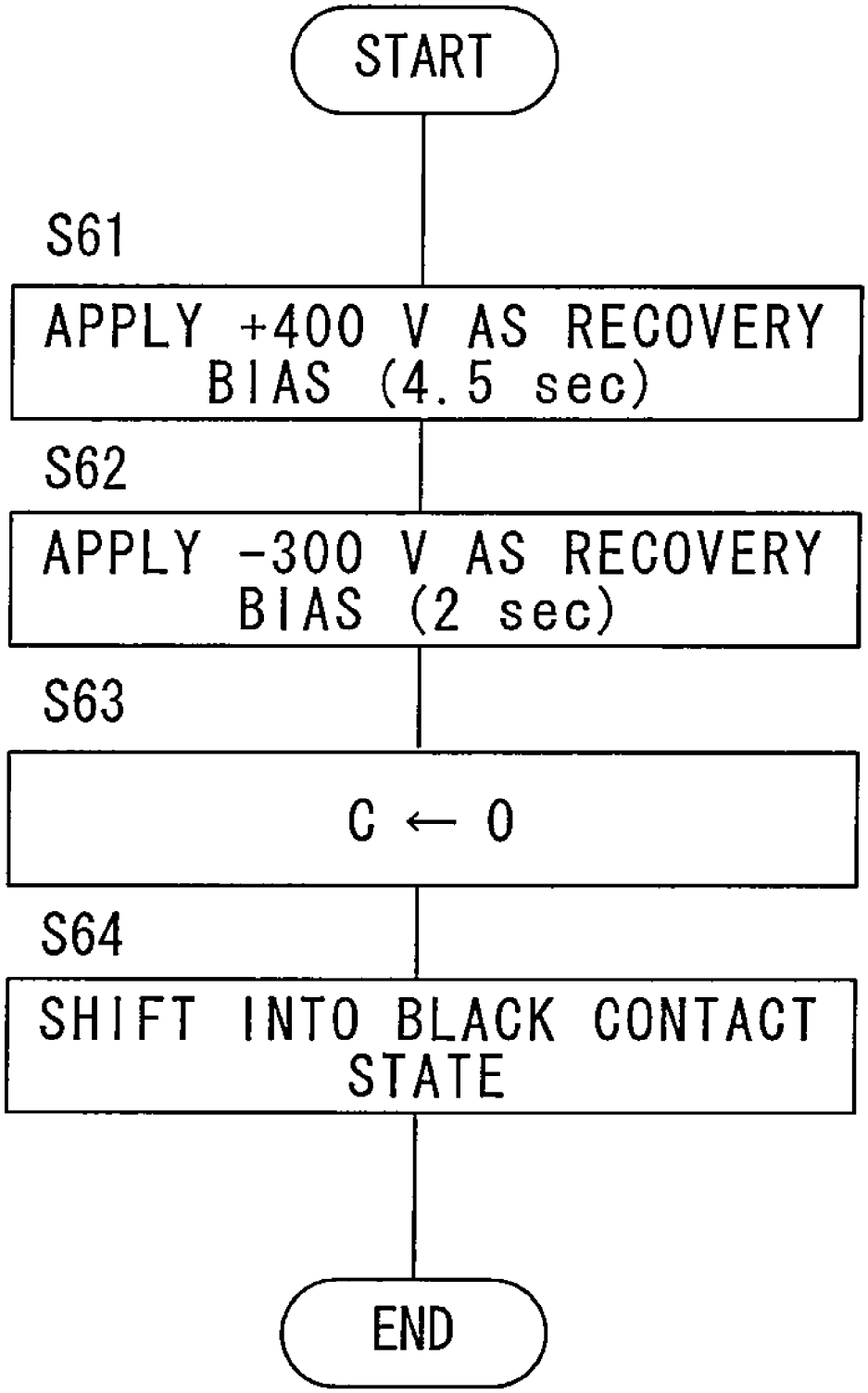
FIG. 7 is a flow chart for explaining a modification of the first toner transferring process.

FIG. 7 is a flow chart for explaining a modification of the first toner transferring process.

In the first toner transferring process shown in FIG. 4, the cleaning of the recovery members 13 is achieved by transferring the toners accumulated on the respective recovery members 13 onto the transport belt 19 via the photosensitive drums 10 with the developing devices 12 kept in the all-color non-contact state. In the modified first toner transferring process shown in FIG. 7, in contrast, the toners accumulated on the respective recovery members 13 are recovered on the developing rollers 14 via the photosensitive drums 10 with the developing devices 12 kept in the all-color contact state.

In the modified first toner transferring process shown in FIG. 7, the photosensitive drums 10 are driven to be rotated and the transport belt 19 is circularly moved with the developing devices 12 kept in the all-color contact state in which all the photosensitive drums 10 are kept in contact with the corresponding developing rollers 14.

The bias applying circuit 42 is controlled to apply +400 V as the recovery bias to the respective recovery members 13 for 4.5 seconds (Step S61). By the application of the recovery bias, the toners accumulated on the respective recovery members 13 are released (transferred) from the recovery members 13 onto the surfaces of the corresponding photosensitive drums 10. Since the photosensitive drums 10 are kept in contact with the corresponding developing rollers 14, the toners released on the photosensitive drums 10 are recovered on the corresponding developing rollers 14 when being brought into opposed relation to the developing rollers 14.

After +400V is applied as the recovery bias to the respective recovery members 13 for the recovery bias application period, the bias applying circuit 42 is controlled to apply a predetermined level of recovery bias to the respective recovery members 13 for two seconds (Step S62). The recovery bias to be applied at this time is determined according the use environment and the like so that the toners remaining on the photosensitive drums 10 can be recovered on the corresponding recovery members 13 and, for example, set at −300 V.

In turn, the count C of the page counter is reset to zero (Step S63).

Thereafter, the switching mechanism 43 is controlled to shift the developing devices 12 from the all-color contact state to the black contact state in which the photosensitive drum 10 of the black processing unit 9K is kept in contact with the corresponding developing roller 14 and the other photosensitive drums 10 are kept apart from the corresponding developing rollers 14 (Step S64). Then, the first toner transferring process ends.

In the first toner transferring process shown in FIG. 7, the developing devices 12 are not shifted into the all-color non-contact state in which all the photosensitive drums 10 are kept apart from the corresponding developing rollers 14, so that the time required for the process can be reduced by the time required for shifting the developing devices 12 from the all-color non-contact state to the black contact state as compared with the first toner transferring process shown in FIG. 4.

Since the developing devices 12 are shifted into the black contact state immediately before the completion of the first toner transferring process, the monochrome printing process can be started immediately after the completion of the first toner transferring process.

Fourth Embodiment

The second toner transferring process shown in FIG. 6 may be performed instead of the first toner transferring process in Steps S6, S8, S11 shown in FIG. 3 or in Steps S36, S38 shown in FIG. 5.

Fifth Embodiment

The first toner transferring process shown in FIG. 4 or FIG. 7 may be performed instead of the second toner transferring process in Step S41 shown in FIG. 5.

Sixth Embodiment

Step S6 shown in FIG. 3 and Step S36 shown in FIG. 5 may be omitted.

Seventh Embodiment

In the embodiments described above, the tandem color laser printer 1 is employed by way of example, but the present invention is applicable to a color laser printer of an intermediate transfer type, in which color toner images are once transferred onto an intermediate transfer belt from respective image carriers, and then collectively transferred onto a sheet from the intermediate transfer belt.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus which is operative in a monochrome mode in which a monochrome image is formed from a black developing agent image and in a color mode in which a color image is formed by superposing images of developing agents of different colors including black and non-black colors, the apparatus comprising:

photosensitive members provided for the respective colors;

developing rollers respectively provided in association with the photosensitive members in such a manner as to be brought into and out of contact with the corresponding photosensitive members, and adapted to supply the developing agents to the corresponding photosensitive members in contact with the corresponding photosensitive members to develop electrostatic latent images respectively formed on the photosensitive members into the developing agent images;

a transfer belt disposed in opposed relation to the respective photosensitive members, and adapted to transfer the developing agent images respectively carried on the photosensitive members onto a transfer object;

recovery members respectively provided in association with the photosensitive members, and adapted to recover parts of the developing agents remaining on the corresponding photosensitive members after the developing agent images are transferred onto the transfer object;

a cleaning member which removes the developing agents from the transfer belt;

a switching mechanism which selectively shifts the developing rollers among an all-color non-contact state in which all the photosensitive members are kept apart from the corresponding developing rollers, a black contact state in which the photosensitive member for black is kept in contact with the corresponding developing roller and the other photosensitive members are kept apart from the corresponding developing rollers, and an all-color contact state in which all the photosensitive members are kept in contact with the corresponding developing rollers; and a control section which, when an operation mode of the apparatus is shifted from the color mode to the monochrome mode, causes the switching mechanism to shift the developing rollers from the all-color contact state to the all-color non-contact state to perform a transferring process to once transfer the developing agents recovered on the respective recovery members onto the corresponding photosensitive members and further transfer the developing agents from the photosensitive members onto the transfer belt.

2. An image forming apparatus according to claim 1, wherein the control section controls potentials of the photosensitive members and/or the recovery members to produce potential differences between the photosensitive members and the recovery members for transferring the developing agents from the recovery members onto the corresponding photosensitive members in the transferring process.

3. An image forming apparatus according to claim 2, further comprising a bias applying circuit which applies a bias to the respective recovery members, wherein the control section controls the bias applying circuit to apply the bias to the respective recovery members for transferring the developing agents from the recovery members to the corresponding photosensitive members in the transferring process.

4. An image forming apparatus according to claim 1, wherein the control section performs the transferring process when the monochrome image formation is carried out in the monochrome mode after the color image formation is repeated a predetermined number of times in the color mode.

5. An image forming apparatus according to claim 1, wherein the transfer belt is a transport belt which transports the transfer object to positions at which the transfer object is opposed to the respective photosensitive members.

6. An image forming apparatus according to claim 5, further comprising a feeding mechanism which feeds the transfer object onto the transport belt, wherein the control section interrupts an operation of the feeding mechanism for a predetermined period after the transferring process is started.

7. An image forming apparatus according to claim 6, wherein the predetermined period is not shorter than a period required for transferring a non-black color developing agent onto the transfer belt from a most upstream one of the photosensitive members for the non-black colors with respect to a transfer object transport direction in which the transfer object is transported by the transport belt.

8. An image forming apparatus according to claim 7, wherein the predetermined period is not shorter than a period required for the cleaning member to remove the non-black color developing agent transferred onto the transfer belt from the most upstream one of the non-black color photosensitive members with respect to the transfer object transport direction.

9. An image forming apparatus according to claim 1, wherein the recovery members each have a roller shape.

10. An image forming apparatus which is operative in a monochrome mode in which a monochrome image is formed from a black developing agent image and in a color mode in which a color image is formed by superposing images of developing agents of different colors including black, the apparatus comprising:

photosensitive members provided for the respective colors;

developing rollers respectively provided in association with the photosensitive members in such a manner as to be brought into and out of contact with the corresponding photosensitive members, and adapted to supply the developing agents to the corresponding photosensitive members in contact with the corresponding photosensitive members to develop electrostatic latent images respectively formed on the photosensitive members into the developing agent images;

a transfer belt disposed in opposed relation to the respective photosensitive members, and adapted to transfer the developing agent images respectively carried on the photosensitive members onto a transfer object;

recovery members respectively provided in association with the photosensitive members, and adapted to recover parts of the developing agents remaining on the corresponding photosensitive members after the developing agent images are transferred onto the transfer object;

a cleaning member which removes the developing agents from the transfer belt;

a switching mechanism which selectively shifts the developing rollers between a black contact state in which the photosensitive member for black is kept in contact with the corresponding developing roller and the other photosensitive members are kept apart from the corresponding developing rollers and an all-color contact state in which all the photosensitive members are kept in contact with the corresponding developing rollers; and a control section which, when an operation mode of the apparatus is shifted from the color mode to the monochrome mode, causes the switching mechanism to shift the developing rollers from the all-color contact state to the black contact state to perform a transferring process to once transfer at least the non-black color developing agents recovered on the corresponding recovery members onto the corresponding photosensitive members and further transfer the developing agents from the corresponding photosensitive members to the transfer belt.

11. An image forming apparatus according to claim 10, wherein the control section controls potentials of the photosensitive members and/or the recovery members to produce potential differences between the photosensitive members and the recovery members for transferring the developing agents from the recovery members onto the corresponding photosensitive members in the transferring process.

12. An image forming apparatus according to claim 11, further comprising a bias applying circuit which applies a bias to the respective recovery members, wherein the control section controls the bias applying circuit to apply the bias to the respective recovery members for transferring the developing agents from the recovery members to the corresponding photosensitive members in the transferring process.

13. An image forming apparatus according to claim 10, wherein the control section performs the transferring process when the monochrome image formation is carried out in the monochrome mode after the color image formation is repeated a predetermined number of times in the color mode.

14. An image forming apparatus according to claim 10, wherein the transfer belt is a transport belt which transports the transfer object to positions at which the transfer object is opposed to the respective photosensitive members.

15. An image forming apparatus according to claim 10, wherein the recovery members each have a roller shape.

16. An image forming apparatus which is operative in a monochrome mode in which a monochrome image is formed from a black developing agent image and in a color mode in which a color image is formed by superposing images of developing agents of different colors including black, the apparatus comprising:

photosensitive members provided for the respective colors;

developing rollers respectively provided in association with the photosensitive members in such a manner as to be brought into and out of contact with the corresponding photosensitive members, and adapted to supply the developing agents to the corresponding photosensitive members in contact with the corresponding photosensitive members to develop electrostatic latent images respectively formed on the photosensitive members into the developing agent images;

a transfer belt disposed in opposed relation to the respective photosensitive members, and adapted to transfer the developing agent images respectively carried on the photosensitive members onto a transfer object;

recovery members respectively provided in association with the photosensitive members, and adapted to recover parts of the developing agents remaining on the corresponding photosensitive members after the developing agent images are transferred onto the transfer object;

a switching mechanism which selectively shifts the developing rollers between a black contact state in which the photosensitive member for black is kept in contact with the corresponding developing roller and the other photosensitive members are kept apart from the corresponding developing rollers and an all-color contact state in which all the photosensitive members are kept in contact with the corresponding developing rollers; and a control section which, when an operation mode of the apparatus is shifted from the color mode to the monochrome mode, performs a transferring process to once transfer the developing agents recovered on the respective recovery members onto the corresponding photosensitive members and further transfer the developing agents from the photosensitive members to the corresponding developing rollers before the switching mechanism shifts the developing rollers from the all-color contact state to the black contact state.

17. An image forming apparatus according to claim 16, wherein the control section controls potentials of the photosensitive members and/or the recovery members to produce potential differences between the photosensitive members and the recovery members for transferring the developing agents from the recovery members onto the corresponding photosensitive members in the transferring process.

18. An image forming apparatus according to claim 17, further comprising a bias applying circuit which applies a bias to the respective recovery members, wherein the control section controls the bias applying circuit to apply the bias to the respective recovery members for transferring the developing agents from the recovery members to the corresponding photosensitive members in the transferring process.

19. An image forming apparatus according to claim 16, wherein the control section performs the transferring process when the monochrome image formation is carried out in the monochrome mode after the color image formation is repeated a predetermined number of times in the color mode.

20. An image forming apparatus according to claim 16, wherein the transfer belt is a transport belt which transports the transfer object to positions at which the object is opposed to the respective photosensitive members.

* * * * *